US007540751B2

(12) United States Patent
Jang et al.

(10) Patent No.: US 7,540,751 B2
(45) Date of Patent: Jun. 2, 2009

(54) METHOD FOR FABRICATING MICROCONNECTOR AND SHAPE OF TERMINALS THEREOF

(75) Inventors: Ben-Hwa Jang, Hsinchu Hsien (TW); Shin-Way Lin, Hsinchu (TW); Wei-Leun Fang, Hsinchu (TW); Wang-Shen Su, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 11/478,658

(22) Filed: Jul. 3, 2006

(65) Prior Publication Data

US 2007/0004256 A1 Jan. 4, 2007

(30) Foreign Application Priority Data

Jul. 1, 2005 (TW) ..... 94122260 A

(51) Int. Cl.
*H01R 13/15* (2006.01)

(52) U.S. Cl. ..... 439/260

(58) Field of Classification Search ..... 439/260, 439/264, 607

See application file for complete search history.

(56) References Cited

U.S. PATENT DOCUMENTS

| | | | | |
|---|---|---|---|---|
| 4,176,900 | A | 12/1979 | Hines et al. | |
| 4,330,163 | A | 5/1982 | Aikens et al. | |
| 4,630,874 | A | 12/1986 | Renn et al. | |
| 4,636,021 | A | 1/1987 | Bobb et al. | |
| 4,684,181 | A * | 8/1987 | Massit et al. | 439/59 |
| 4,684,194 | A | 8/1987 | Jenkins et al. | |
| 5,092,789 | A | 3/1992 | Sinclair | |
| 5,172,050 | A | 12/1992 | Swapp | |
| 5,578,526 | A * | 11/1996 | Akram et al. | 438/107 |
| 5,655,917 | A * | 8/1997 | Kaneshige et al. | 439/155 |
| 5,898,159 | A * | 4/1999 | Huang | 235/441 |
| 5,923,225 | A | 7/1999 | De Los Santos | |
| 6,129,570 | A * | 10/2000 | Griffin et al. | 439/260 |
| 6,537,090 | B2 * | 3/2003 | Ozawa | 439/159 |
| 6,773,280 | B2 * | 8/2004 | Sasaki et al. | 439/159 |
| 6,817,776 | B2 | 11/2004 | Colgan et al. | |
| 2005/0224507 | A1 * | 10/2005 | Gavin et al. | 220/836 |

FOREIGN PATENT DOCUMENTS

| | | |
|---|---|---|
| CN | 2699526 Y | 5/2005 |
| TW | 595826 | 6/2004 |
| TW | M260896 | 4/2005 |

* cited by examiner

*Primary Examiner*—Tho D Ta
*Assistant Examiner*—Travis Chambers
(74) *Attorney, Agent, or Firm*—Rabin & Berdo, P.C.

(57) ABSTRACT

A method for fabricating a microconnector and the shape of terminals of the microconnector is proposed, which combines a cover with a base as a female connector, inserts an inserting member as a male connector between the cover and the base, and the ends of the terminals at the base electrically connecting the inserting member undergoing plasma treatment for controlling the shape thereof. The terminals of the microconnector can be actuated with by a low voltage. By such arrangement, the inserting member can be firmly engaged and the intervals between terminals and the overall size of the microconnector can be reduced while providing low insertion force and electrostatic actuating force.

15 Claims, 20 Drawing Sheets

<Position along beam length ( a quarter of millimeter)>

METHOD FOR FABRICATING MICROCONNECTOR AND SHAPE OF TERMINALS THEREOF

BACKGROUND OF THE INVENTION

1. Field of the Invention

The present invention relates generally to an electrical connecting technology, more particularly, a method for fabricating a microconnector and the shape of terminals of the microconnector.

2. Description of the Background Art

Generally, the function of a connector is to provide a separable interface for connecting subsystems in an electronic system, so as to transmit signal and/or electric power. Connectors have been employed for a long time, the number of related patents and technology are vast, e.g., U.S. Pat. Nos. 4,176,900; 4,330,163; 4,630,874; 4,636,021; 4,684,194; 5,092,789; 5,172,050 and 6,817,776, Taiwan Laid-Open Patent for Invention No. 595826, Taiwan Utility Model Certificate No. M260896 and the like. In order to maintain stability of the contacting interface during operation of the electronic system, conventional connectors produce normal contact force at the contacting interface. However, due to more and more pins are designed on the connectors of the integrated circuit and the printed circuit boards, high insertion force may be produced during assembling in U.S. Pat. No. 4,176,900, for example. Furthermore, in order to reduce the insertion force, the normal contact force often must be sacrificed; but, when the normal contact force is insufficient, contact resistance increases, causing more signal attenuation. Accordingly, a connector with zero insertion force is proposed in U.S. Pat. No. 5,092,789, for example.

U.S. Pat. No. 5,092,789 provides a beam connected between a lid member and a base member that is pressed after insertion of a CPU, so that the lid member translates forward with respect to the base member, causing the slot of the base member to latch on the pins of the CPU to provide normal force. Such connector can solve the contradiction of the previous technology that concurrently requires high normal contact force and lower insertion force, but due to limitations of the traditional mechanical mold fabrication and metallic terminal stamping technique, the minimum interval between the terminals that can be made is about 0.3 mm, and cannot be diminished further.

In order to address the issue of further minimization of connectors limited by traditional fabricating method, Michael P. Larsson and Richard R. A. Syms et al. had proposed a self-aligning micro-electro-mechanical system (MEMS) in-line separable electrical connector in pages 365 to 376 of Chapter 2 in Part 13 of the Journal of Microelectromechanical Systems published in April, 2004. In contrast to those connectors fabricated with the above traditional technology, this connector is fabricated by the microelectromechanical fabricating process, and it has a self-aligning mechanical structure.

However, friction may be produced when the male terminals are inserted into the female terminals of the above connector; it not only degrades the integrity of signal transmission, but is also adverse to the design of multi-terminal connector. Simultaneously, without the design for impedance matching, such conventional connector affects the bandwidth of signal transmission. In addition, the connector fabricated by the technology does not take into account of shielding EMI (electromagnetic interference), which results in the phenomenon of noise produced between devices interfering with the normal operation of other devices. Furthermore, such conventional connector does not propose a suitable latchable mechanism, it may result in situations that the male terminals cannot be properly inserted into the female terminals or has poor contact after insertion. Accordingly, such conventional connector is yet to be improved.

Furthermore, the conventional MEMS component must firstly go through a fabricating process of wire bonding or solder ball bonding in order to be connected to testing apparatus for functional tests, i.e., each time the component is tested it must be encapsulated through wire bonding or solder ball bonding, such that the component cannot be reworked, and the related testing apparatus cannot be used again, which is a waste of time and cost. In addition, most of the above conventional techniques results in high insertion force, which will quickly wear out the terminals. Furthermore, thermal effect produced at high temperature during the MEMS fabricating process may cause the female terminals to curve downwards when the sacrificial layer is released, such that electrical signals cannot be successfully transmitted when the male terminals are inserted into the female terminals; or cause the female terminals to curve upwards, so that they encounter "kinking effect" when the male terminals are inserted thereto.

Accordingly, there exists a strong need in the art to solve the drawbacks of the above-described conventional technology, such as high insertion force, overlarge size, lack of impedance matching, electromagnetic interference shielding and latchable mechanism and is unfavorable to multi-terminal connector design.

SUMMARY OF THE INVENTION

Accordingly, it is an objective of the present invention to solve the aforementioned problems by providing a method for fabricating a microconnector and the shape of terminals of the microconnector with lower insertion force that reduces the overall size of the microconnector and the gaps between the terminals.

It is another objective of the present invention to provide a method for fabricating a microconnector and the shape of terminals of the microconnector with low insertion force by lower electrostatic actuation.

It is a further objective of the present invention to provide a method for fabricating a microconnector and the shape of terminals of the microconnector with engaging functionality.

It is yet objective of the present invention to provide a method for fabricating a microconnector and the shape of terminals of the microconnector with EMI shielding and adjustable terminal impedance.

It is one other objective of the present invention to provide a method for fabricating a microconnector and the shape of terminals of the microconnector which reduces the cost of manufacturing.

It is yet further objective of the present invention to provide a method for fabricating a microconnector and the shape of terminals of the microconnector which reduces the testing time and cost.

It is yet another objective of the present invention to provide a method for fabricating a microconnector and the shape of terminals of the microconnector, in which the microconnector can be applied to reworkable 3D packaging.

It is a yet one other objective of the present invention to a method for fabricating a microconnector and the shape of terminals of the microconnector which increases design versatility.

In order to attain the objectives mentioned above and the others, a method for fabricating a microconnector and the shape of terminals of the microconnector according to the present invention is proposed. The microconnector comprises a base, a cover and an inserting member. The base is provided with a first electrical connecting section and a barb section. The cover is disposed over the base, forming a first gap between the first electrical connecting section and the barb section. The inserting member is to be inserted into the first gap and fixed by the barb section, and a second electrical connecting section is provided on the inserting member for electrically connecting to the first electrical connecting section of the base.

Preferably, the base is a structure made of silicon. The ends of the first electrical connecting section and the barb section curve upwards. The first electrical connecting section comprises a plurality of female connectors. The barb section comprises at least a spring plate. The cover is provided with a first dent, a plurality of second dents and a third dent, wherein, the plurality of second dents are formed at the bottom of the first dent. In a preferred embodiment, the plurality of second dents are a plurality of hollows arranged periodically, and the sunken depth of the third dent is larger that the first dent, so that a second gap is further formed between the cover and the first electrical connecting section and the barb section. The cover is preferably a structure made of silicon. In a preferred embodiment, an undercut is further formed at the cover corresponding to the edge of the first gap. The second electrical connecting section comprises a plurality of male connectors. The cover is combined with the base to form a female connector, and the inserting member is a male connector, wherein, the cover is combined with the base via gel or semiconductor fabricating processes.

A method for fabricating the shape of the terminals of the aforementioned microconnector is further proposed, the characteristic feature in that: the first electrical connecting section and the barb are curved upwards by a plasma treatment. The plasma treatment includes the steps of providing a photo mask with an opening, aligning the opening at the ends of the first electrical connecting section and/or the barb section and performing the plasma treatment. In one preferred embodiment, the plasma treatment is performed with ammonia or other equivalent compound.

Compared to the conventional technology that compromises normal contact force and hence greater attenuation of signals for reduced insertion force, the present invention provides the base together with the cover as a female connector with lower insertion force. Furthermore, the terminals of the base can be actuated with low electrostatic actuating force, which does not degrade the normal contact force. The method for fabricating the microconnector according to the present invention also enables vertical connections of devices, thus increasing device density. Additionally, the intervals between the terminals of the microconnector of the present invention can be reduced to further reduce the overall size of the device. The various predefined dents designed on the cover as well as the second gap designed between the cover and the base effectively provide EMI shielding and impedance matching.

Simultaneously, components applying the microconnector of the present invention can be tested and burn-in before the components are encapsulated, unlike in the traditional wire bonding or solder ball bonding technique, the component encapsulation must be performed before system function can be properly tested. Additionally, since components applying the present invention do not need to be encapsulated before testing, components can be easily replaced without discarding the entire package. Thus, the present invention further reduces manufacturing cost, testing time and testing cost, and allows rework.

In addition, the present invention is not limited to the mass memory applications, but is also suitable for any chip connection. Furthermore, the base can be made of silicon, thereby providing high-power dissipation capability and high reliability. Furthermore, the present invention can be applied to integrate passive components, controllers and buffers, and can be flexibly designed and/or applied to fabricate related device and platform as required.

The following description contains specific information pertaining to the implementation of the present invention. One with ordinary skill in the art will readily recognize other advantages and features of the present invention after reviewing what specifically disclosed in the present application. It is manifest that the present invention can be implemented and applied in a manner different from that specifically discussed in the present application. It should also be understood that the invention is not limited to the particular exemplary embodiments described herein, but is capable of many rearrangements, modifications, and substitutions without departing from the spirit of the present invention.

DESCRIPTION OF THE PREFERRED EMBODIMENTS

The following embodiments are used to specifically illustrate the concepts of the present invention, they are not intended to limit the scope of the present invention in any way.

First Embodiment

Figure 1:
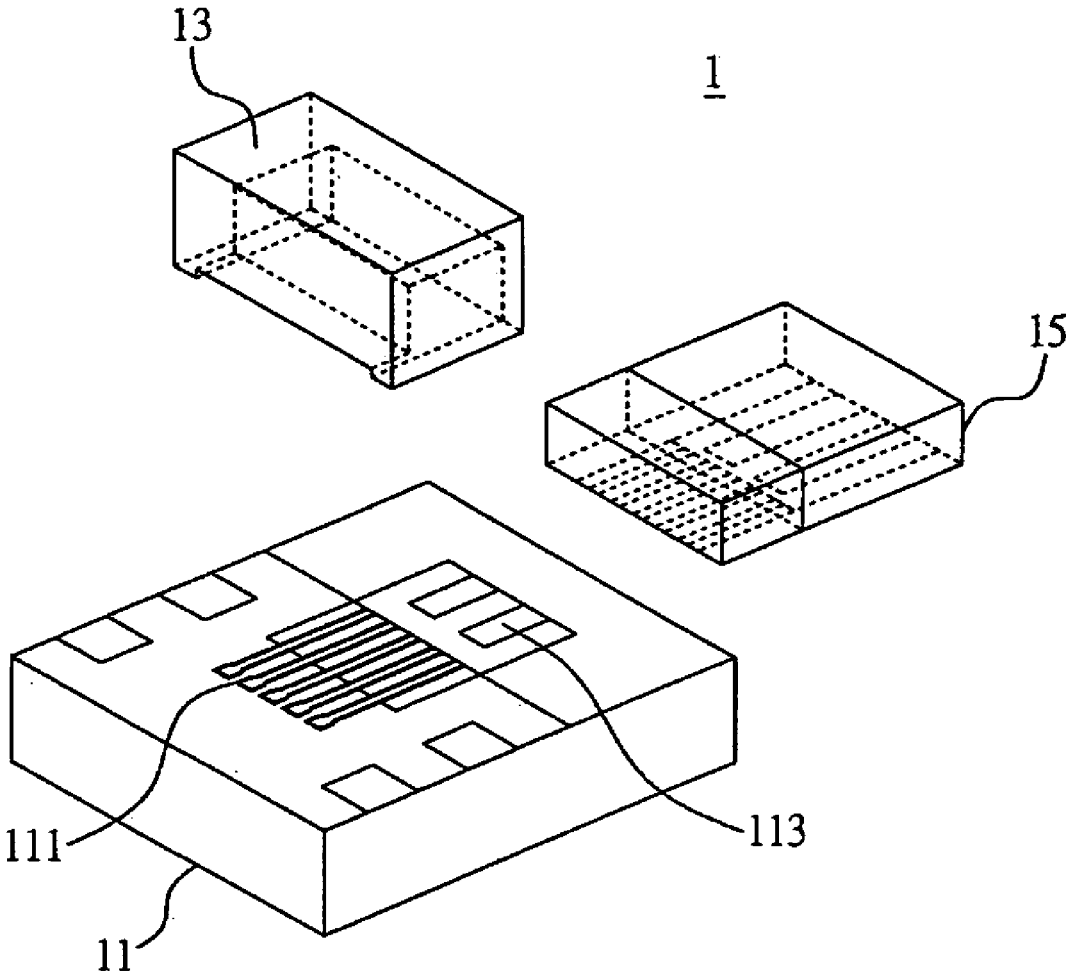
FIG. 1 depicts an exploded schematic diagram of the microconnector structure according to a preferred embodiment of the present invention.

With reference to FIGS. 1 through 11C, shown are schematic diagrams according to a first embodiment of the method for fabricating a microconnector and the shape of terminals of the microconnector of the present invention. Referring to FIG. 1, the microconnector 1 comprises a base 11, a cover 13 and an inserting member 15.

The base 11 is provided with a first electrical connecting section 111 and a barb section 113 thereof. In this exemplary embodiment, the base 11 can be a structure made of material such as silicon; the first electrical connecting section 111 can be composed of a plurality of female terminals and the barb section 113 can be, for example, a spring plate. The ends of the first electrical connecting section 111 and the barb section 113 are both cambered structure curving upwards. Wherein, the method for fabricating the first electrical connecting section 111 and the barb section 113 in the base 11 will be described later.

Figure 2:
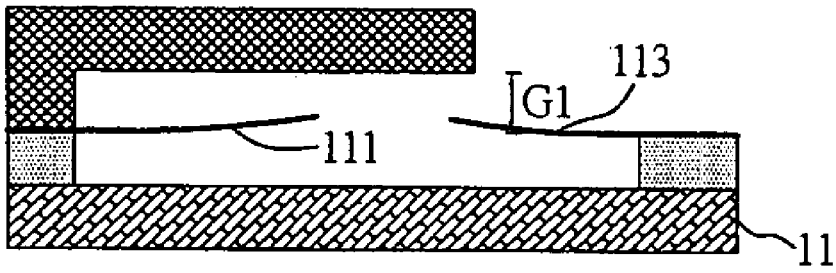
FIG. 2 is a cross sectional view of the base and the cover in FIG. 1.

With reference to FIG. 2, the cover 13 is disposed over the base 11, forming a gap G1 (the first gap) between the first electrical connecting section 111 and the barb section 113. The cover 13 can also be a structure made of material such as silicon. Wherein, the cover 13 is combined with the base 11 via gel or traditional semiconductor bonding method.

Figure 3A:
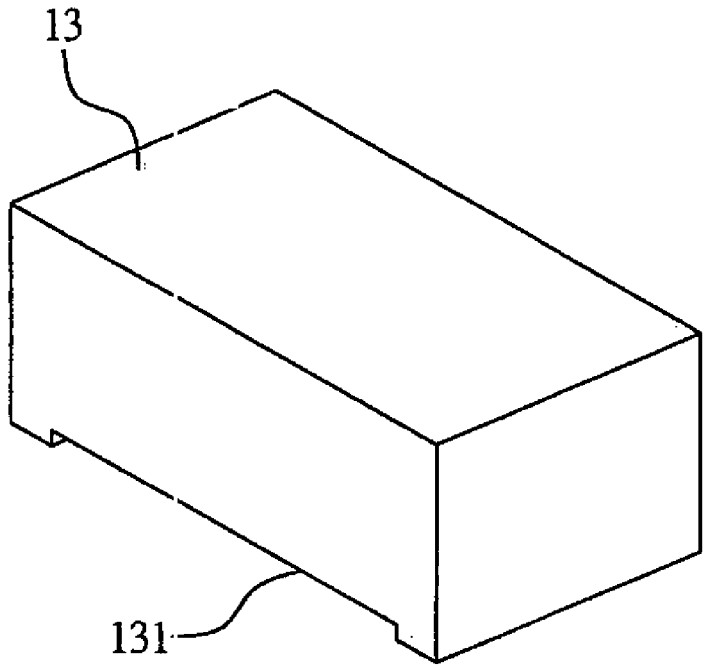
FIGS. 3A and 3B depict structure of the cover in FIG. 1.
Figure 3B:
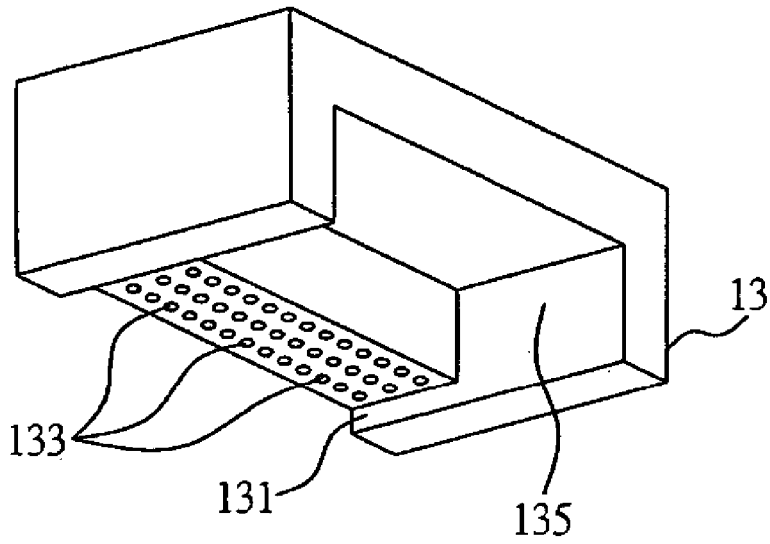
Figure 3C:
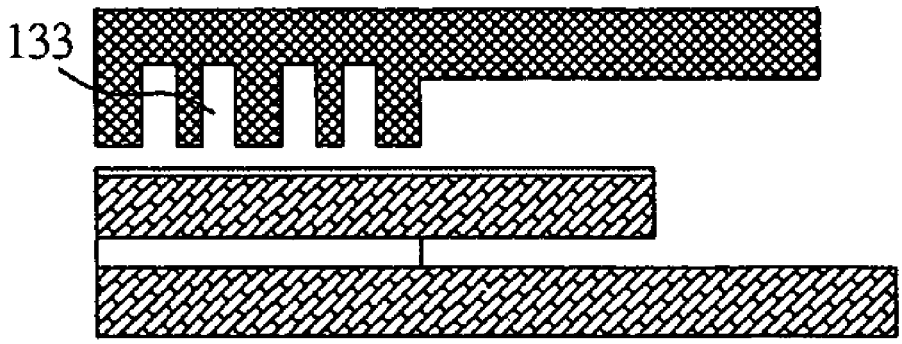
FIGS. 3C and 3D show the positional relationships between the second dents and the first dent of the cover and the first electrical connecting section of the base, respectively.
Figure 3D:
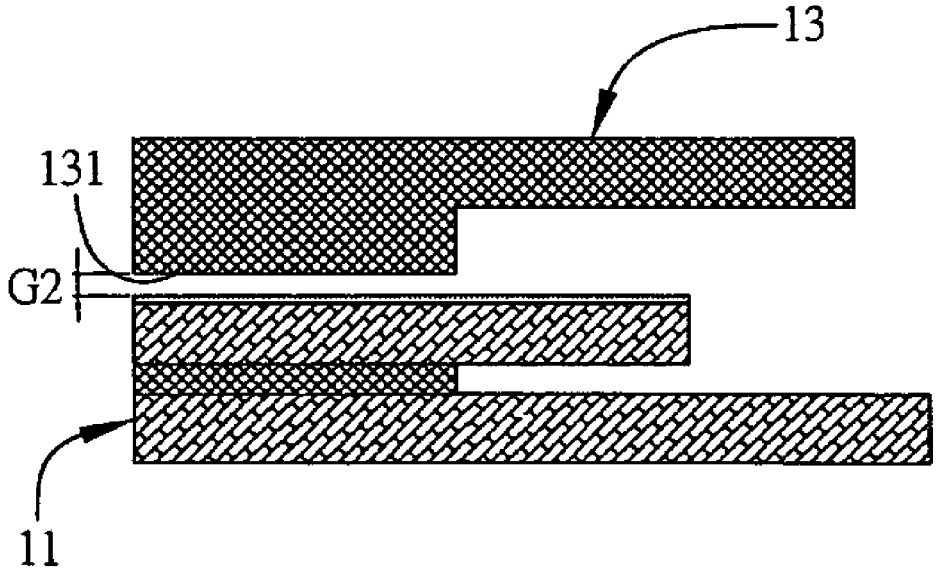

With reference to FIGS. 3A and 3B, the cover 13 is further provided with a first dent 131, a plurality of second dents 133 and a third dent 135. The plurality of second dents 133 are formed at the bottom of the first dent 131, furthermore, referring to FIG. 3C, such plurality of second dents 133 are for example a plurality of hollows arranged periodically as required, thereby enhancing rigidity of the overall structure, as well as providing EMI shielding effect. The above feature is based on the principle of photonic crystal bandgap, and, for example, U.S. Pat. No. 5,923,225 also applies this principle to the printed circuit board, so it will not be described in detail. The sunken depth of the third dent 135 is larger than that of the first dent 131, so that the gap G1 is formed between the cover 13 and the first electrical connecting section 111 and the barb section 113, and it can also be used for positioning the inserting member 15 when it is combined with the base 11 and the cover 13. Thus, referring to FIG. 3D, a gap G2 is further formed between the cover 13 and the first electrical connecting section 111; thereby the impedance at the rear of the first electrical connecting section 111 not contacting the second electrical connecting section 151 can be controlled by the gap G2, matching the front and rear impedances.

Figure 4:
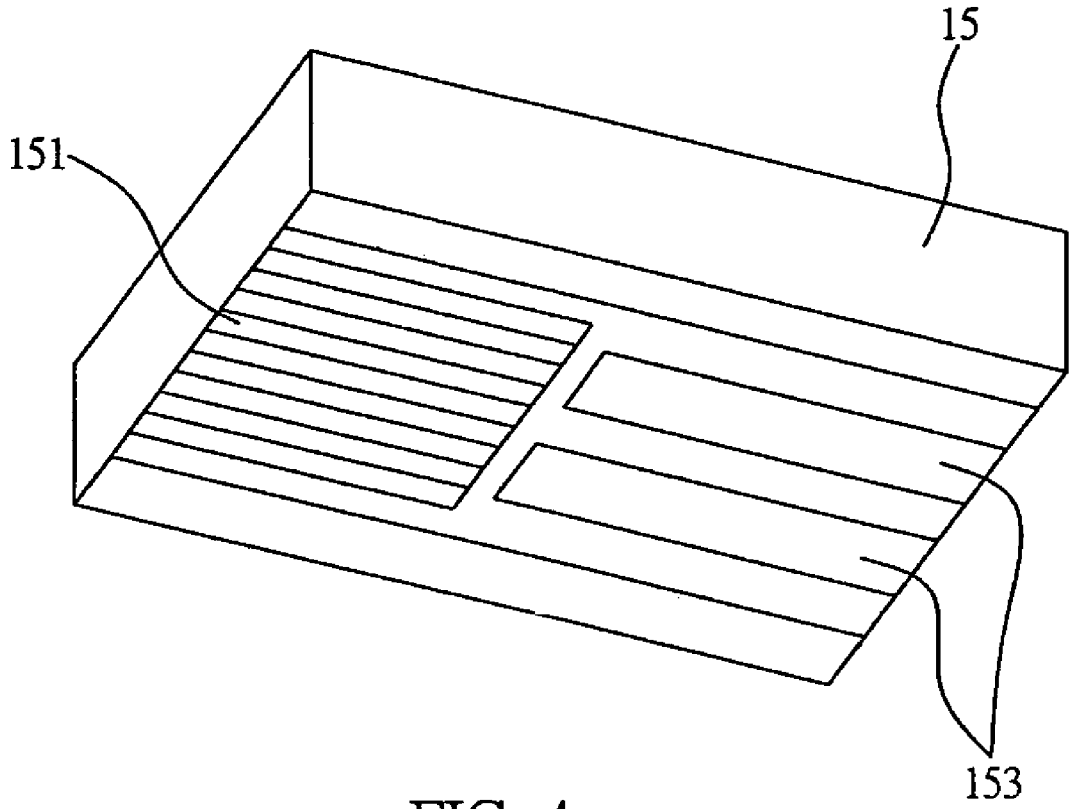
FIG. 4 depicts a structure of the inserting member in FIG. 1.

The inserting member 15 is inserted in the gap G1 and fixed by the barb section 113 (will be described in detail later). The inserting member 15 can be designed as a COMS circuit, a MEMS device or other variations. Referring to FIG. 4, the inserting member 15 is provided with a second electrical connecting section 151 for electrically connecting to the first electrical connecting section 151 and a dent section 153 provided corresponding to the barb section 113. The second electrical connecting section 151 can be composed of a plurality of male terminals; the barb section 113 can be a structure with locking function. Wherein, the cover 13 together with the base 11 is a female connector, while the inserting member 15 is a male connector corresponding thereto.

Figure 5A:
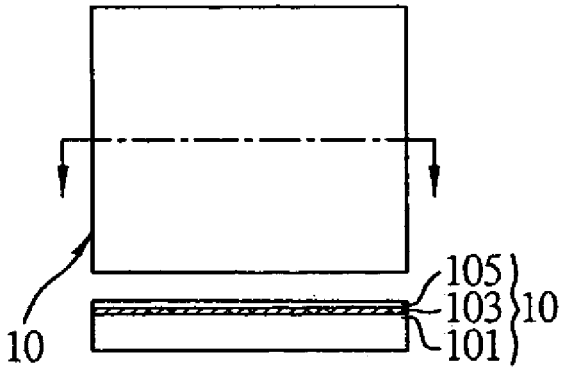
FIGS. 5A through 5P depict the method for fabricating the shape of terminals of the microconnector according to a preferred embodiment of the present invention.
Figure 5B:
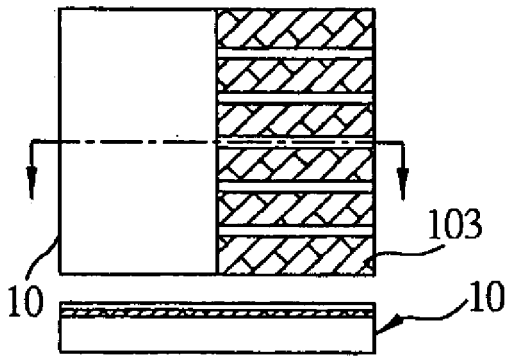
Figure 5C:
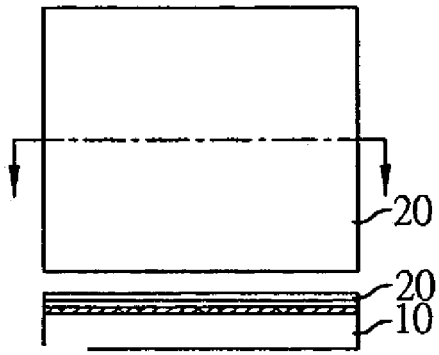
Figure 5D:
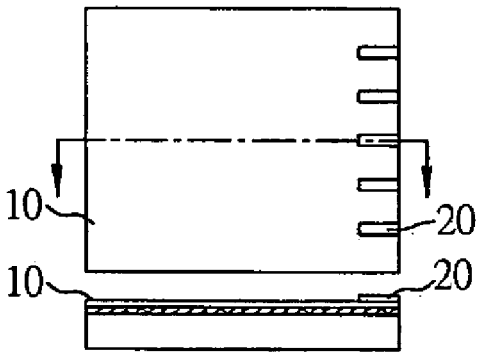
Figure 5E:
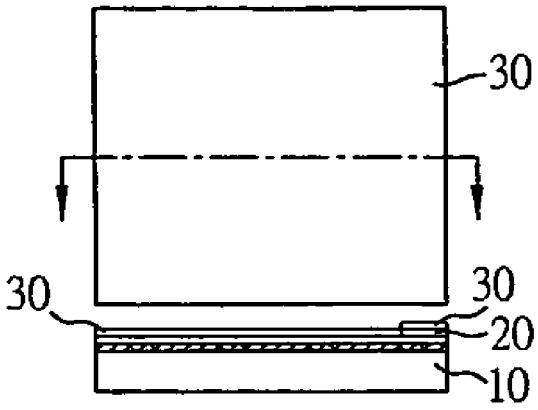
Figure 5F:
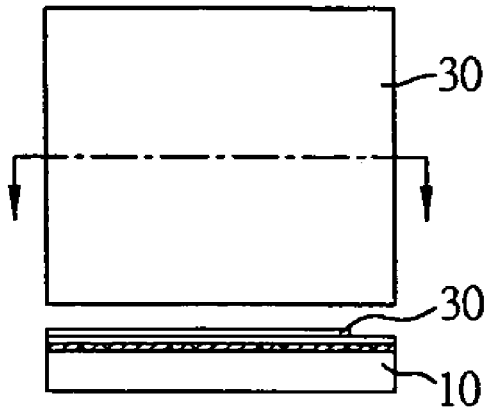
Figure 5G:
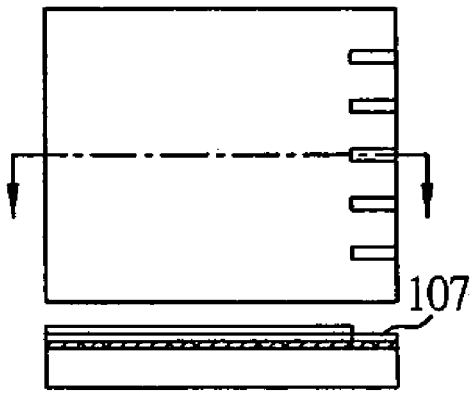
Figure 5H:
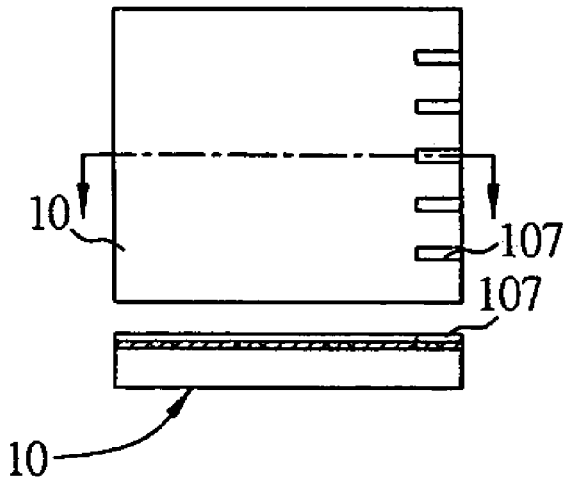
Figure 5I:
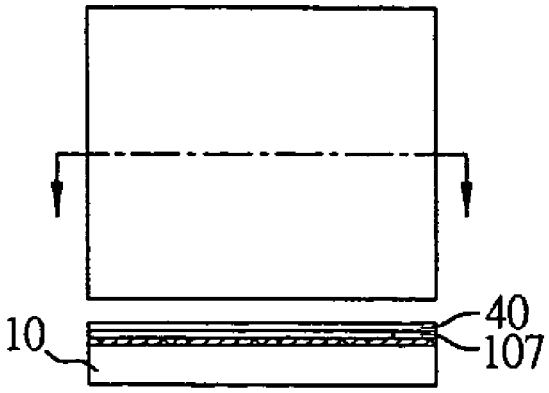
Figure 5J:
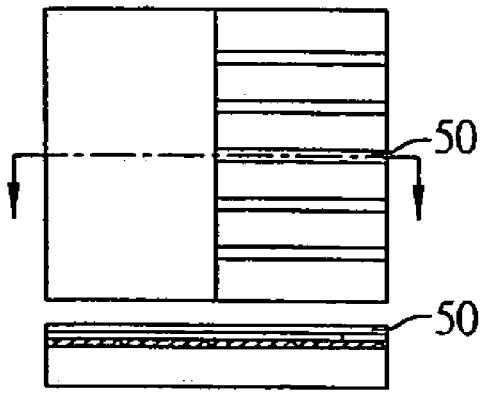
Figure 5K:
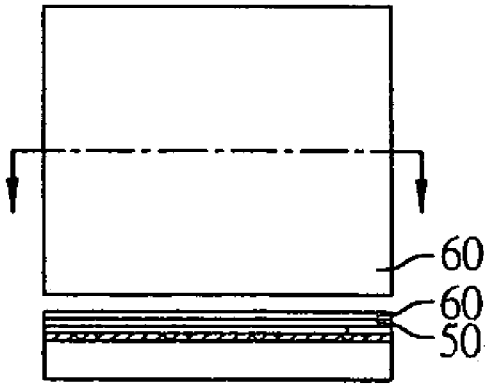
Figure 5L:
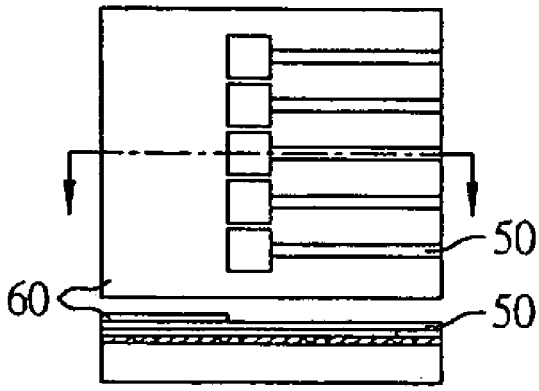
Figure 5M:
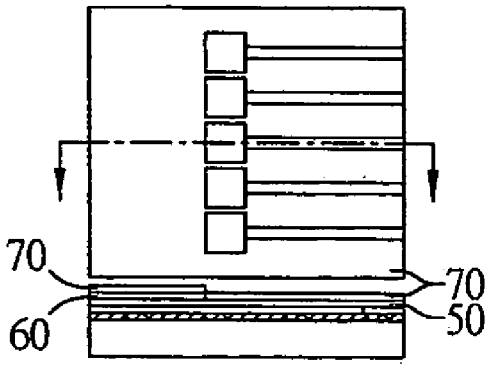
Figure 5N:
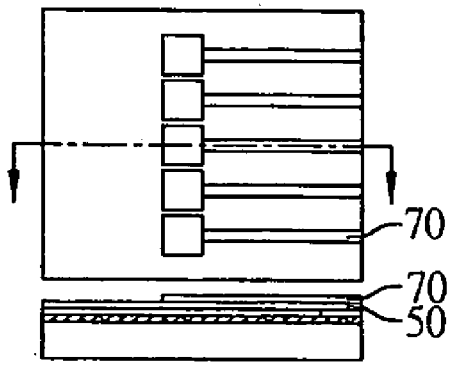
Figure 5O:
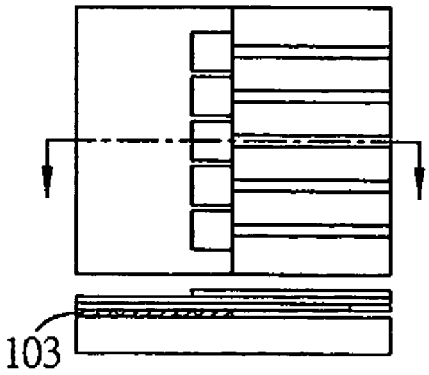
Figure 5P:
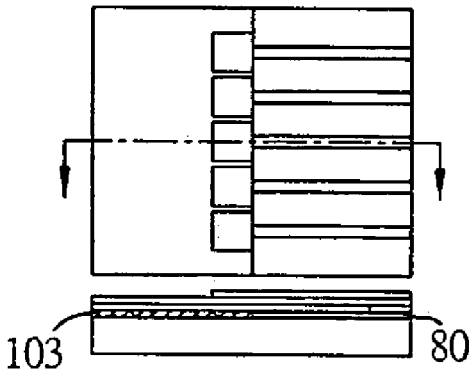

In this exemplary embodiment, the base 11 can be formed selectively by the fabricating process shown in FIGS. 5A through 5P. However, attention should be paid to that the first electrical connecting section 111 and the barb section 113 can be simultaneously formed in the base 11, or alternatively, the first electrical connecting section 111 can be firstly formed in the base 11 and the barb section 113 can be formed in the base 11. In order to simplify the drawing and illustrate the present invention in a clear and concise manner, merely the part relating to formation of the first electrical connecting section 111 in the base 11 is described.

With reference to FIG. 5A, firstly providing a wafer 10, the wafer 10 can be a silicon on insular (SOI) wafer, which includes a silicon substrate 101, a $SiO_2$ insulating layer 103 disposed on the silicon substrate 101 and a silicon layer 105 disposed on the insulating layer 103. Wherein, the fabricating process of the SOI wafer is known in the art and is thus omitted. Then, etching the wafer 10 using a photo mask, and as shown in FIG. 5B, part of the insulating layer 103 of the wafer 10 is exposed. Next, referring to FIG. 5C, forming a photo resist layer 20 on the wafer 10 by spin coating. Thereafter, as shown in FIG. 5D, performing patterning on the photo resist layer 20 using a photo mask, leaving a part of photo resist layer 20 on the surface of the wafer 10. Then, performing sputtering process on the wafer 10 and the photo resist 20, so as to form the metallic layer 30 as shown in the FIG. 5E. Next, lifting off the photo resist layer 20 and the metallic layer 30 on the photo resist layer 20, so as to expose a part of the surface of the wafer 10 as shown in FIG. 5F, i.e., forming a plasma treatment region 107 of the first electrical connecting section 111 that is to be formed into terminals. Then, with reference to FIG. 5G, performing plasma treatment on the plasma treatment region 107 of the first electrical connecting section 111, so as to control the curvature of the plasma treatment region 107 of the first electrical connecting section 111.

Then, removing the metallic layer 30, and exposing the wafer 10 and the plasma treatment region 107 as shown in FIG. 5H. Next, referring to FIG. 5I, forming an insulating layer 40, such as $Si_xN_y$, on the wafer 10 and the plasma treatment region 107, for example, via deposition. Thereafter, patterning to remove part of the $Si_xN_y$ insulating layer 40, so as to form a pattern 50 as shown in FIG. 5J. Then, again by spin coating, forming a photo resist layer 60 on the pattern 50 as shown in FIG. 5K. Next, with reference to FIG. 5L, patterning via a photo mask to remove part of the photo resist layer 60 and exposing the pattern 50. Then, as shown in FIG. 5M, forming a metallic layer 70 by sputtering, so as to cover the photo resist layer 60 and the pattern 50. Then, as shown in FIG. 5N, removing part of the metallic layer 70, so as to expose the part except for the partial pattern 50 in FIG. 5L. Next, as shown in FIG. 50, removing part of the insulating layer 103. Finally, as shown in FIG. 5P, coating macromolecule insulating material, such as $H_2O_2$ or Parylene, on the part that the insulating layer 103 is removed as insulating layer 80 to avoid short circuit.

Thus, a cambered structure curving upwards can be formed at the ends of the first electrical connecting section 111 and the barb section 113 as shown in FIG. 2.

Figure 6:
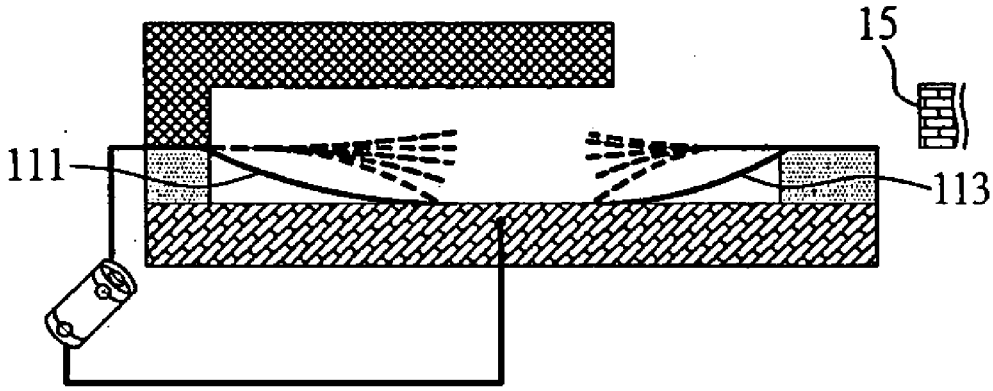
FIG. 6 depicts a schematic diagram of static actuating force produced by imposing voltage.
Figure 7:
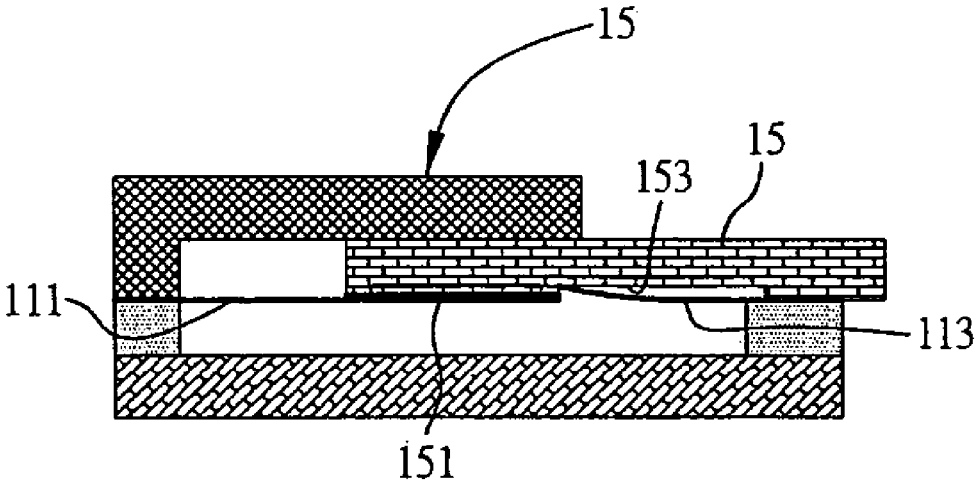
FIG. 7 is a cross-sectional view of the microconnector when the inserting member has been inserted between the cover and the base.
Figure 8A:
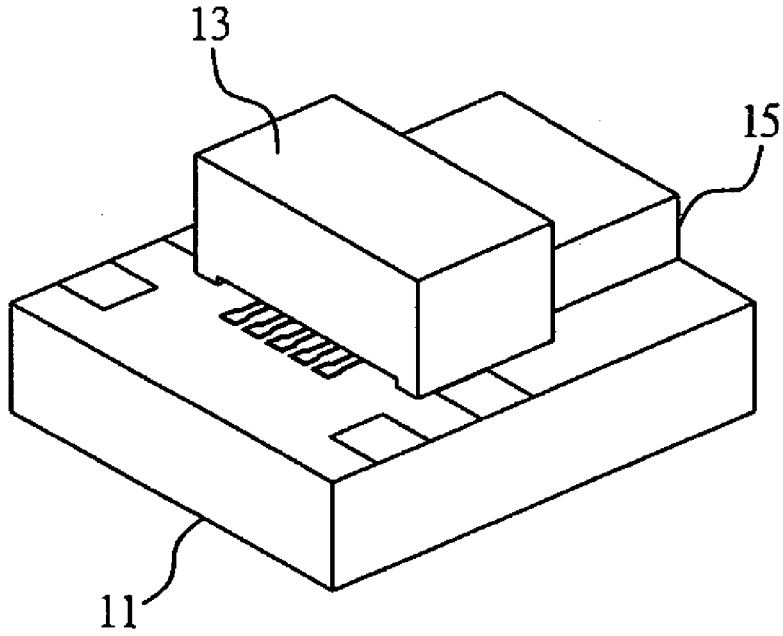
FIGS. 8A and 8B depict assembled microconnector and its perspective view, respectively.
Figure 8B:
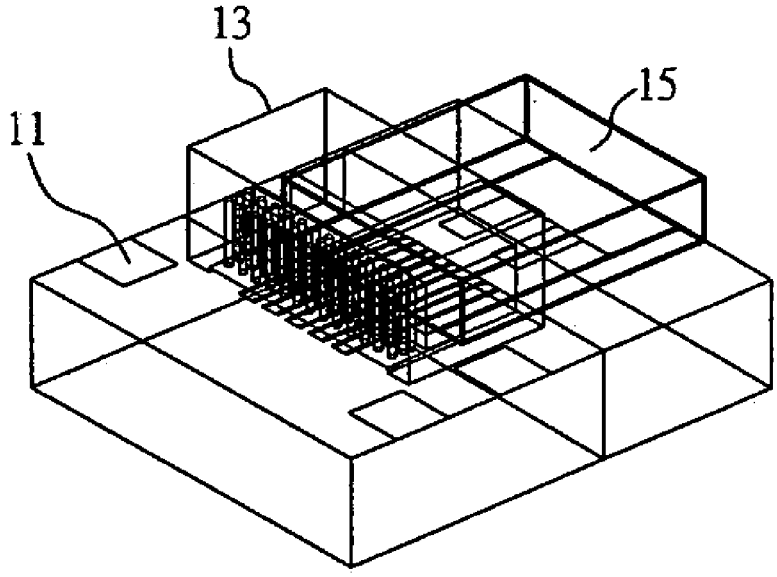

The top and the underside of the base 11 are both conductive layers (i.e., the silicon substrate 101 and silicon layer 105), and the middle is the insulating layer (i.e. the insulating layer 103). Accordingly, as shown in FIG. 6, when applying a voltage through the upper and lower conductive layers, electrostatic actuating force can be produced, forcing the ends of the first electrical connecting section 111 and the barb section 113 can be respectively bent downwards. Since the first electrical connecting section 111 and the barb section 113 have respectively been treated with plasma treatment, the actuating effect can be produced by applying only relatively lower voltage, so the electrostatic actuating force is a low electrostatic actuating force. In the meantime, the inserting member 15 can be inserted and employs sliding contact, which avoids the wearing problem and kinking effect caused by the conventional technology when the male and female terminals are mated. The voltage can be stopped after the inserting member 15 is inserted. Thus, as shown in FIG. 7, the ends of the first electrical connecting section 111 and the barb section 113 can respectively return to the original state (position), so that the first electrical connecting section 111 is electrically connected with the second electrical connecting section 151 of the inserting member 15, and the barb section 113 can be engaged with the dent section 153 of the inserting member 15. As shown in FIGS. 8A and 8B after mounting, the cover 13 is provided on the base 11, the inserting member 15 can be inserted into the gap between the cover 13 and the base 11 with a low insertion force.

Figure 9:
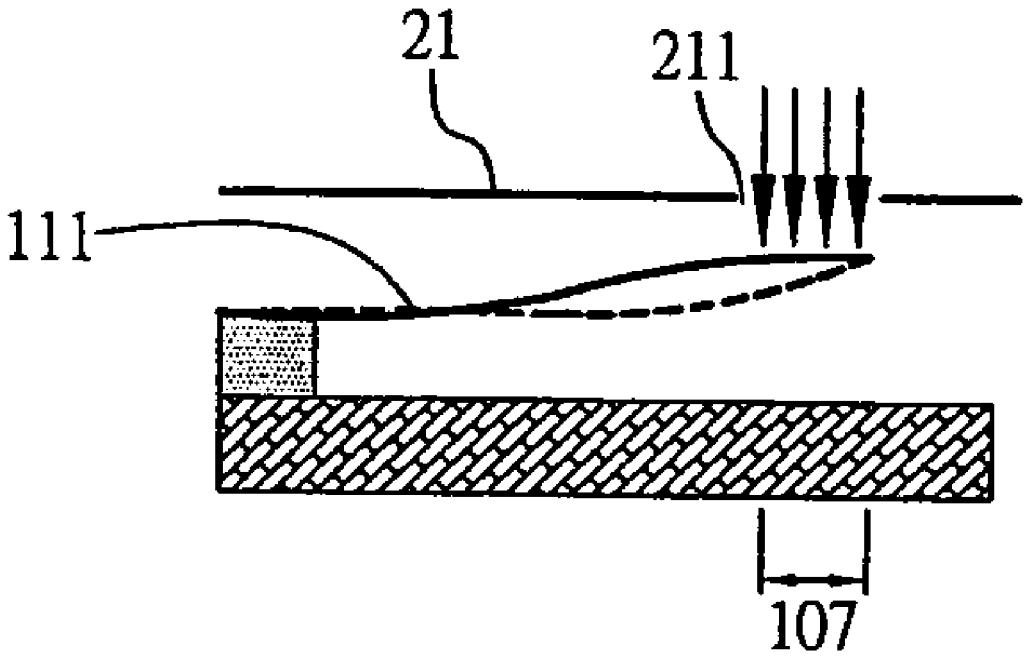
FIG. 9 depicts the fabricating process of plasma treatment performed on the terminals of the microconnector.
Figure 10A:
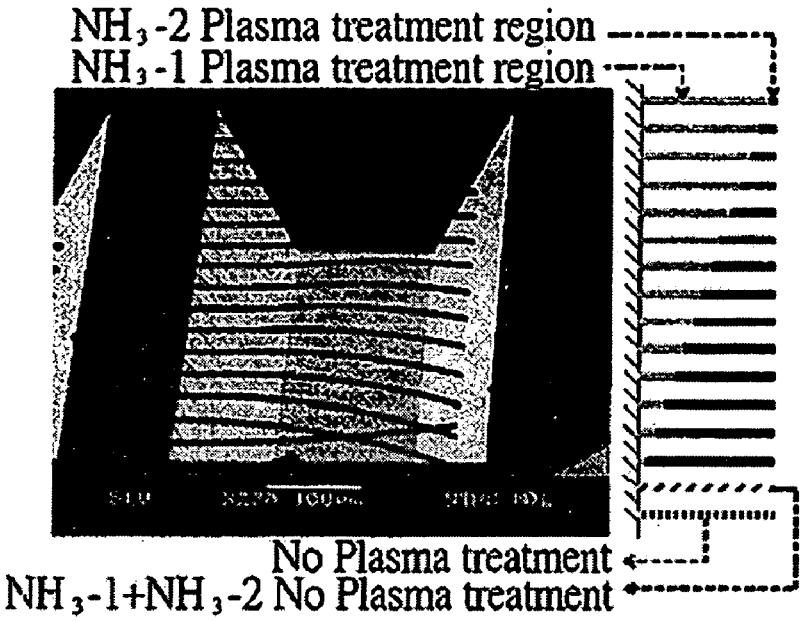
FIGS. 10A and 10B are schematic diagrams showing the experimental result of the plasma treatment of FIG. 9.
Figure 10B:
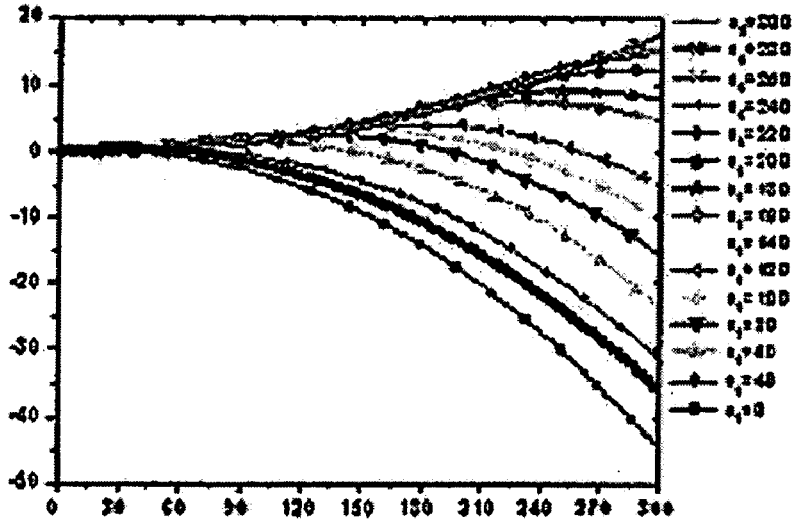

In the discussion above, the plasma treatment can be performed as shown in FIG. 9, providing a photo mask 21 on the first electrical connecting section 111, wherein an opening 211 of the photo mask 21 is aligned to the region of the plasma treatment region 107 of the first electrical connecting section 111. The plasma treatment region 107 of the first electrical connecting section 111 is then treated with ammonia ($NH_3$) or equivalent compound, thereby forming the required shape, i.e., the ends are curved upwards. Similarly, the plasma treatment region of the barb section 113 can undergo the plasma treatment while forming the barb section 113, so as to control the curvature of the barb section 113. Meanwhile, the most suitable application for the present invention can be selected from the test results shown in FIGS. 10A and 10B, for example, in one embodiment, X1=160 or 180 in FIG. 10B.

Figure 11A:
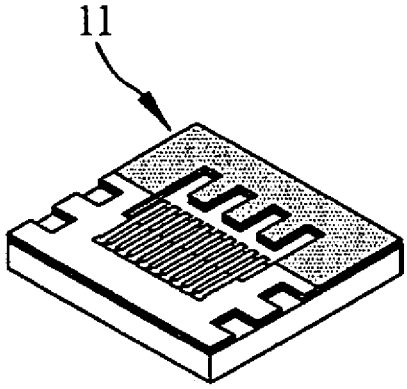
FIGS. 11A through 11C depict different implementations of the base.
Figure 11B:
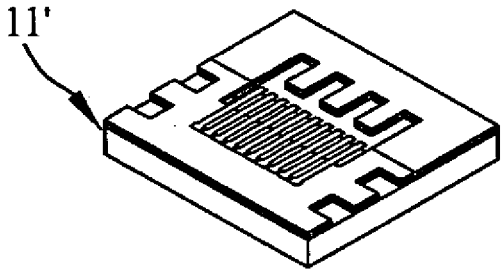
Figure 11C:
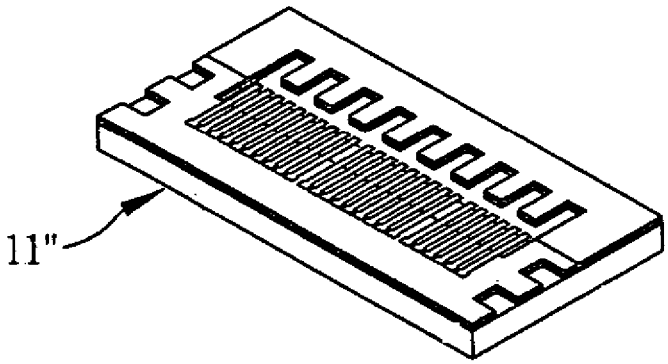

Additionally, two barb sections 113 are illustrated for the above embodiment, but the configuration of the barb section is not limited to this, but can also be such as those shown in FIGS. 11A, 11B or 11C, in which the base 11' and 11" can be designed flexibly according to different requirements. Wherein, the number of the barb section 113 can be changed by altering the structure of the photo mask.

In addition, the actual number and position of various dents as described in the method for fabricating a microconnector and the shape of terminals of the microconnector according to the present invention depend on actual requirement. The processes and steps described above can be replaced by other equivalent techniques and/or carried out in other equivalent sequences that are readily apparent to those with ordinary skill in the art.

Second Embodiment

Figure 12:
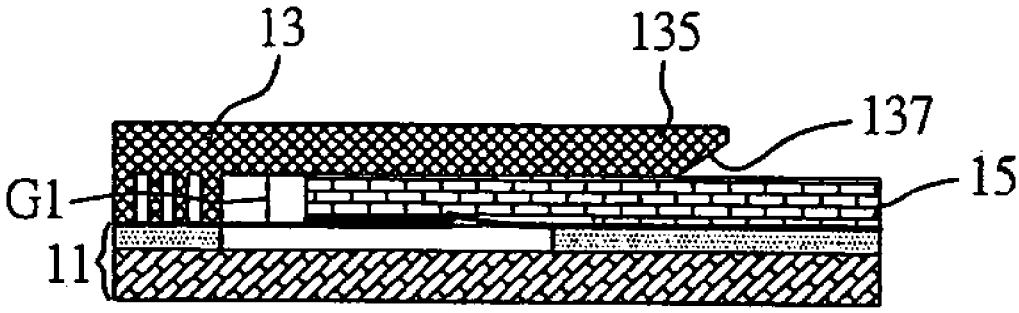
FIG. 12 is a schematic diagram according to a second embodiment of the present invention.

With reference to FIG. 12, shown is a schematic diagram according to a second embodiment of the present invention. Wherein, the components identical or similar to those described in the above embodiment are represented by identical or similar symbols, and descriptions thereof are omitted in order to illustrate the present invention in a clear and concise manner.

In contrast to the first embodiment, the second embodiment comprises an undercut 137 formed at the third dent 135 of the cover 13 corresponding to the edge of the gap G1, allowing the inserting member 15 to be more readily inserted between the cover 13 and the base 11. Apparently, one with ordinary skill in the art can recognize that the size of the undercut is not limited to that shown in this embodiment.

Accordingly, the insertion force can be further lowered.

First Application

Figure 13A:
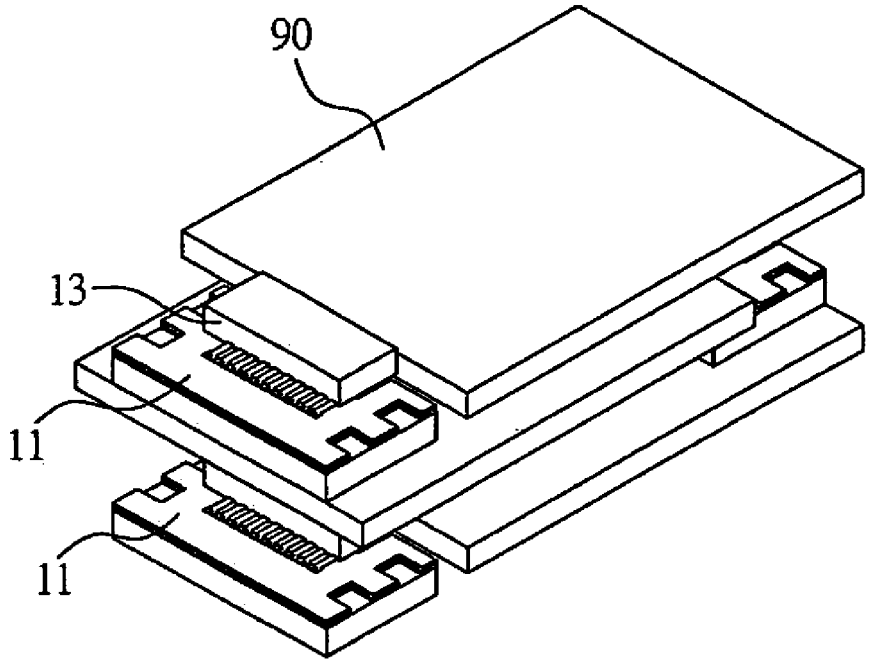
FIGS. 13A and 13B are schematic diagrams of a first application of the preferred embodiment of the present invention.
Figure 13B:
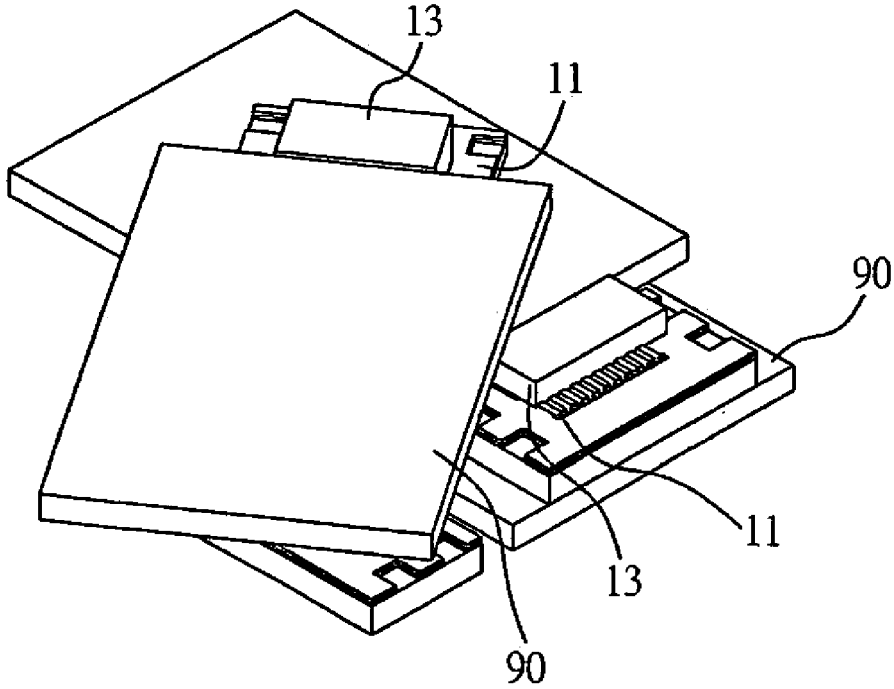

With reference to FIGS. 13A and 13B, shown are schematic diagrams according to a first application of the present invention. Wherein, components identical or similar to those described in the above embodiments are represented by identical or similar symbols, and descriptions thereof are omitted in order to illustrate the present invention in a clear and concise manner.

Referring to FIG. 13A, in contrast to the above embodiments, the terminals of a CMOS circuit 90 can be instead inserted into the gap between the base 11 and the cover 13 acting as the female connector. Accordingly, such microconnector can be applied in 3-D (three-dimensional) package of integrated circuits, which overcome the problem that the device cannot be reworked in the traditional 3-D packaging using wires or solder balls for bonding.

Furthermore, referring to FIG. 13B, the mounting manner of the base 11 and the cover 13 with the CMOS circuit is not limited to that shown in FIG. 13A, but can be adjusted or designed as required. Accordingly, such microconnectors have more versatility in design than the conventional technology.

Accordingly, the microconnectors according to the present invention can be used in the development of a reworkable 3-D integrated circuit packaging.

Second Application

Figure 14A:
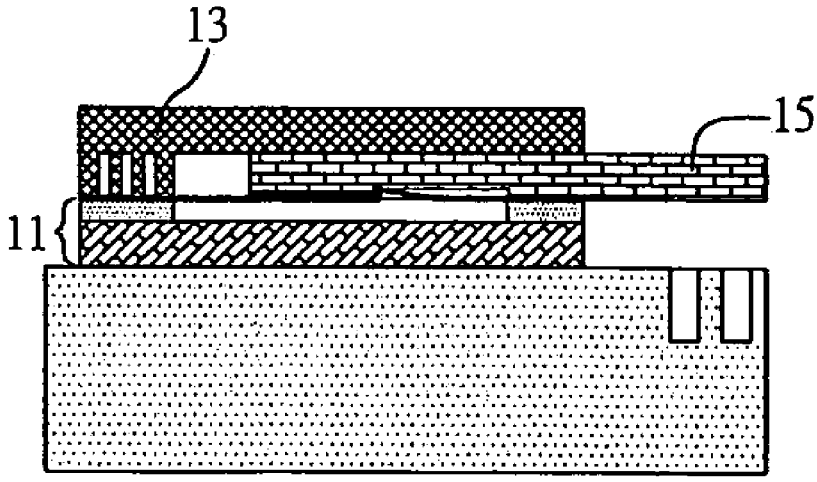
FIGS. 14A and 14B are schematic diagrams of a second application of the preferred embodiment of the present invention.
Figure 14B:
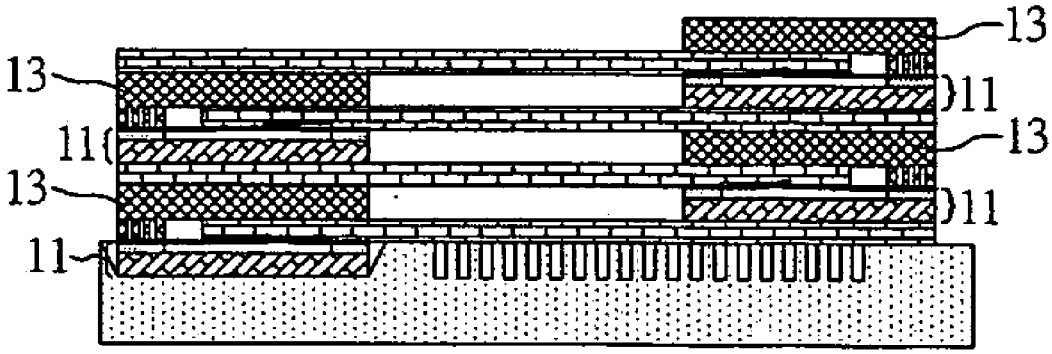

With reference to FIGS. 14A and 14B, shown are schematic diagrams of a second application of the present invention. Wherein, components identical or similar to those described in the above embodiments are represented by identical or similar symbols, and descriptions thereof are omitted in order to illustrate the present invention in a clear and concise manner.

Referring to FIG. 14A, when the microconnector according to the present invention is applied to the surface of a circuit board or a silicon substrate, the inserting member 15 hangs above the surface, thereby slightly increasing the overall height. The hanging state may cause the inserting member 15 to deform. Thus, referring to FIG. 14B, a dent is formed on the surface of the circuit board or the silicon substrate for providing enough space to contain the microconnector, so as to receive the base 11 in the dent and keep the inserting member 15 just above the surface of the circuit board. Accordingly, the overall size can be decreased. Simultaneously, when multi-layer microconnector is required, various layers of microconnectors can be stacked in a crisscross manner shown in FIG. 14B to maintain the overall size in a minimum state.

Third Application

Figure 15:
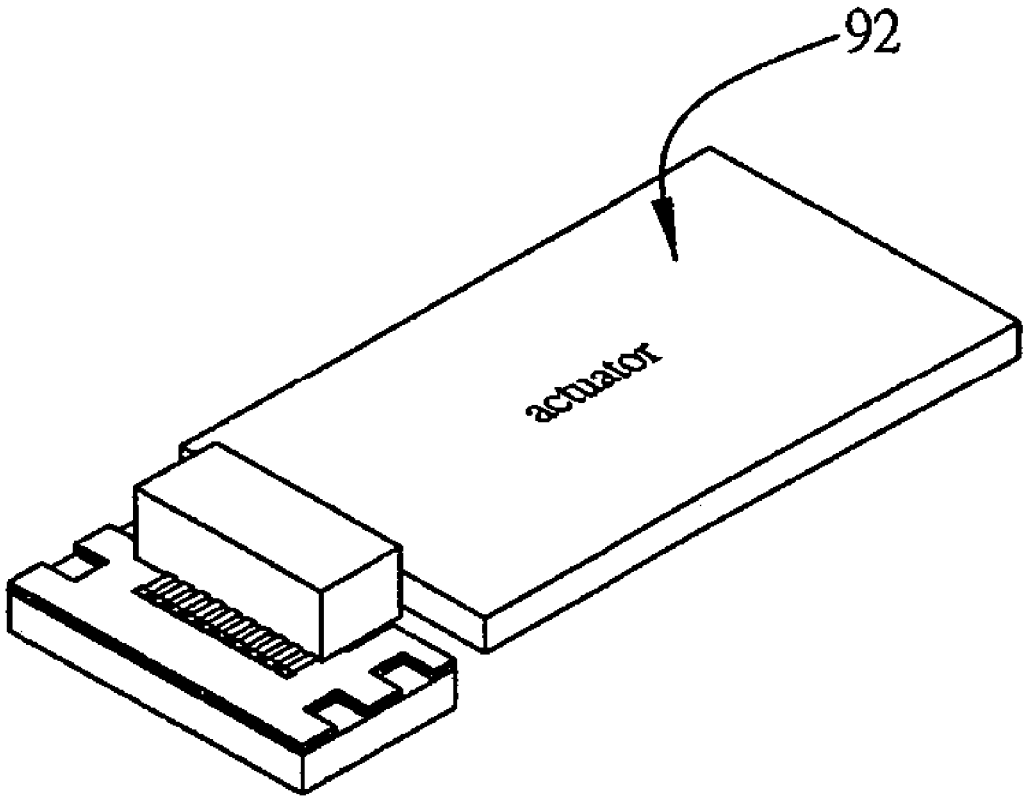
FIG. 15 is a schematic diagram of a third application of the preferred embodiment of the present invention.

With reference to FIG. 15, terminals of a MEMS actuator 92 can be inserted into the gap between the base 11 and the cover 13 acting as the female connector. Accordingly, when functions of the MEMS actuator need to be tested, unlike the conventional technology, it is not necessary to complete packaging before the system function test can be carried out, so the microconnector can be used repeatedly, and the test time and cost required can be significantly reduced compared to the prior art.

Accordingly, the microconnectors according to the present invention can be applied to the development of the testing platform for MEMS components. Thus, as long as the electrical connecting pins of the MEMS components are compatible with the microconnector, the performance of the components can be tested without preliminary packaging, and the microconnector can be used repeatedly, thereby the test time and cost can be significantly reduced.

FIRST COMPARATIVE EXAMPLE

Figure 16A:
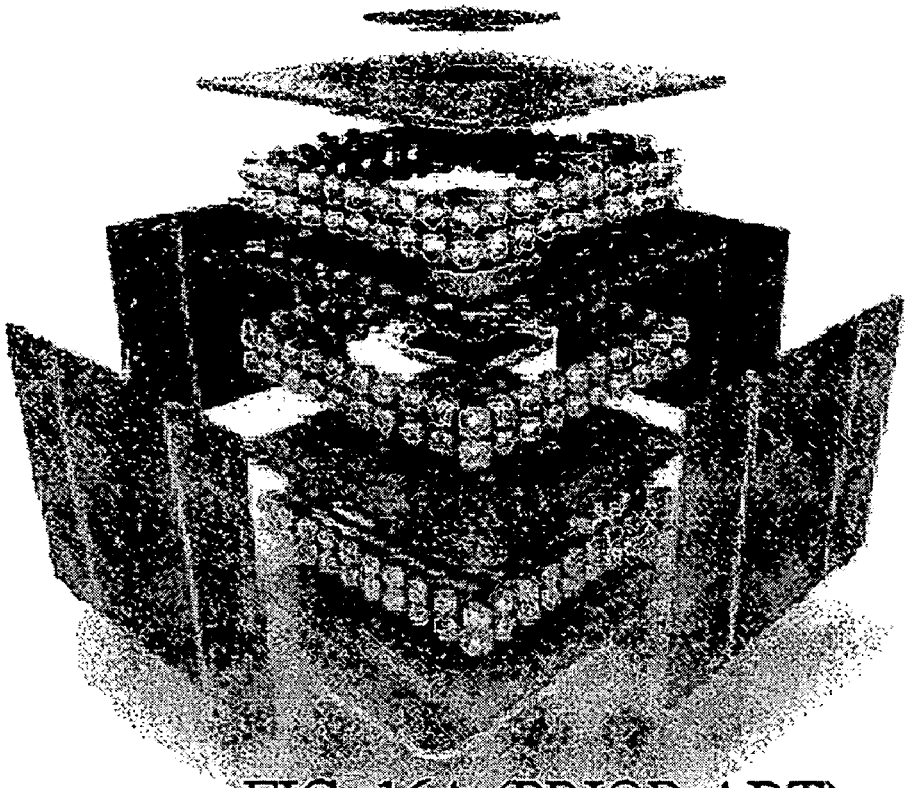
FIG. 16A (PRIOR ART)
FIGS. 16A and 16B (PRIOR ART) show a first comparative example of a package structure of the prior art in comparison with the first and the second applications.
Figure 16B:
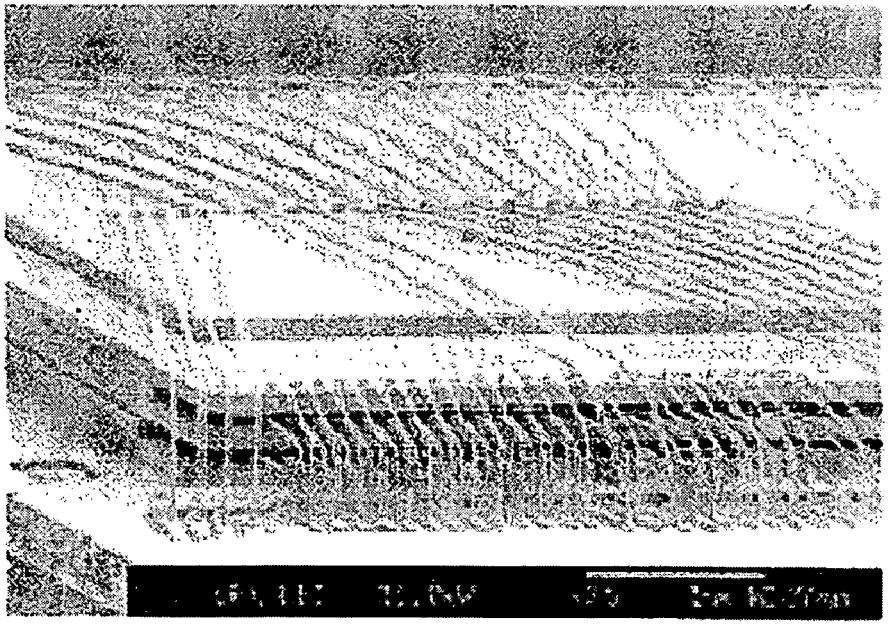
FIG. 16B (PRIOR ART)

With reference to FIGS. 16A and 16B, shown are comparative schematic diagrams to the above-discussed first and the second applications, wherein, FIG. 16A shows a 3-D package by traditional solder ball bonding, and FIG. 16B is a 3-D package by traditional wire bonding.

Compared to FIGS. 16A and 16B, the 3-D package shown in FIGS. 13A and 13B are more flexible in design. In addition, when any component needs to be replaced, the component can be easily taken out for the 3-D package in FIGS. 13A and 13B; while the 3D package shown in FIGS. 16A and 16B has to be discarded entirely, i.e. no rework is possible. Accordingly, the present invention reduces manufacturing cost and enables reworking.

The 3D package of FIG. 16A employs solder ball bonding, so not only components cannot be replaced, the overall size is inevitably large due to its packaging manner. The present invention can relatively diminish the size of the device, and merely replace the damaged component thereof without discarding the entire device.

In addition, as far as the common wire bonding is concerned, the 3-D package of FIG. 16B may employ inductive wires, which have higher noise at the ground plane for high-speed transmission. Accordingly, in order to maintain integrity during high-speed signal transmission, additional filter element is often added at the rear of the wires to eliminate the noise, this increases the area occupied by the component. In comparison, the present invention can fulfill impedance matching without filter element, omitting component required for eliminating noise and diminishing the area occupied by the component, thereby the cost can be relatively reduced.

Fourth Application

Figure 17:
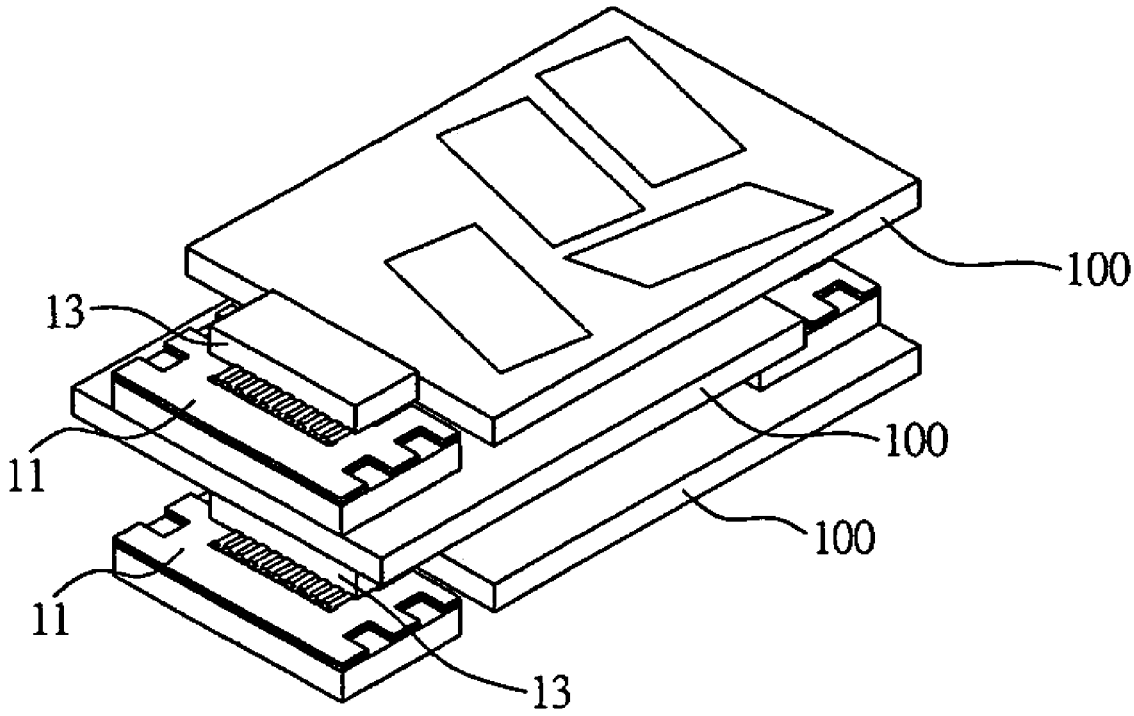
FIG. 17 is a schematic diagram of a fourth application of the preferred embodiment of the present invention.

With reference to FIG. 17, shown is a schematic diagram of a fourth application of the present invention. Wherein, components identical or similar to those described in the above embodiments are represented by identical or similar symbols, and descriptions thereof are omitted in order to illustrate the present invention in a clear and concise manner.

MCU (multi chip module), which solves the problems of lack of density and functionality of a single chip, can now be combined with the 3-D package above. Referring to FIG. 17, the base 11 and cover 13 of the present invention can be combined as a multi chip module (MCM) 100 with 3-D package. Wherein, the advantages and applications of the 3-D package and the MCM are well known to those with ordinary skill in the art, so it will not be further described.

SECOND COMPARATIVE EXAMPLE

Figure 18A:
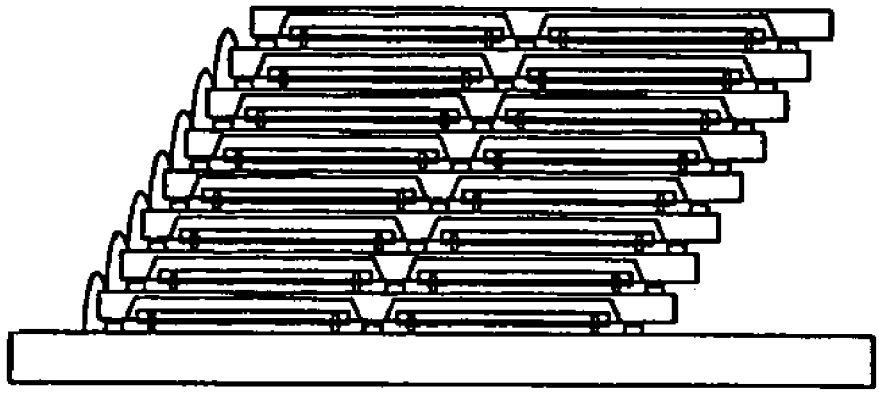
FIG. 18A (PRIOR ART)
FIGS. 18A and 18B (PRIOR ART) show a second comparative example of a package structure of the prior art in comparison with the fourth application.
Figure 18B:
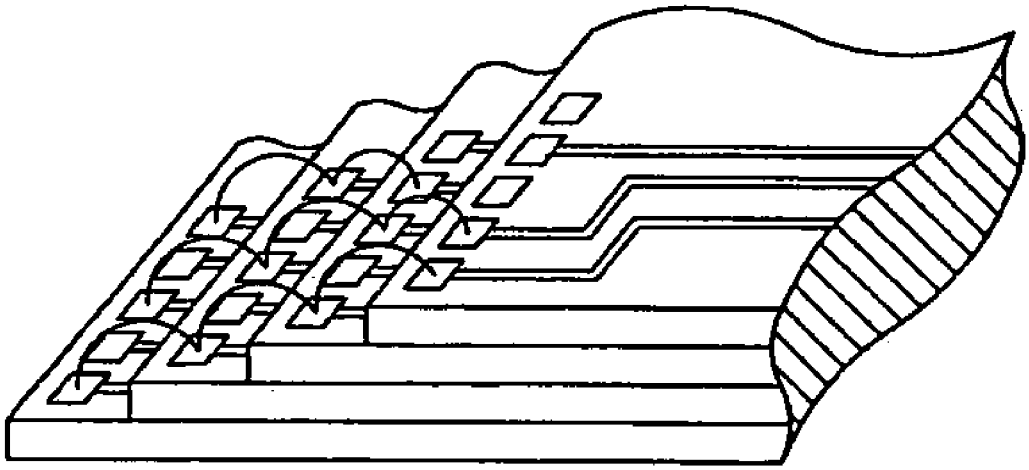
FIG. 18B (PRIOR ART)

With reference to FIGS. 18A and 18B, shown are comparative schematic diagrams to the fourth application above, wherein, FIGS. 18A and 18B depict MCM with a 3D package via wire bonding.

Combining a 3-D package with a MCM is becoming more popular. Presently, 3-D packaging via solder ball bonding is still the most popular approach. However, compared to FIGS. 18A and 18B, the MCM shown in FIG. 17 can replace any of the components as required, in addition, it can also diminish the overall size. Furthermore, the microconnector can be fabricated by MEM batch production. Accordingly, microconnectors adopting the method of present invention can be fabricated more efficiently, decreasing the manufacturing cost and the overall size further.

Compared to the conventional technology, the male and female connectors of the microconnector according to the present invention have low insertion force, no contact wear out and kinking effect. Additionally, the shape of the terminals can be controlled via plasma treatment, so only a low electrostatic actuating voltage is required to produce an actuating effect. In addition, without compromising normal force for lower insertion force as in the conventional technology, the normal force can be suitably controlled by applying the present invention. Furthermore, the present invention using SOI wafer to fabricate and control the shape of the terminals can be easily carried out, so that the manufacturing cost can be lowered, and intervals between terminals can be reduced since the overall size of the connector is not limited by the related fabricating processes, thereby avoiding the drawbacks of the conventional technology.

Furthermore, the present invention provides at least a barb section with engaging capability, which can be used to fabricate latchable MEMS connector. Concurrently, there is a certain gap between the cover and the terminals of the present invention, so controllable impedance can be provided; the cover of the present invention further provides a plurality of dents based on a photonic crystal structure, so EMI shielding can also be provided. In addition, the microconnector of the present invention can be easily assembled, and the microconnector according to the present invention has more design versatility, any of the components can be replaced as required, i.e. rework capability is provided.

Accordingly, the method of fabricating a microconnector and the shape of terminals of the microconnector according to the present invention is applied to reduce the overall size of the microconnector while reducing intervals between the terminals. The manufacturing cost, testing time and cost can also be decreased by virtue of the batch fabrication. The microconnector further has the ability to be reworked, thereby enhancing design versatility and industrial value, thus various drawbacks of the conventional technology can be solved.

Accordingly, the above-described exemplary embodiments and applications are to describe various objectives and features of the present invention in an illustrative and not restrictive sense. Without departing from the disclosed spirit and technical scope of the present invention, all equivalent changes and modifications to the disclosure of the present invention is considered to fall within the appended claim.

What is claimed is:

1. A microconnector, comprising:

a base provided with a first electrical connecting section and a barb section opposite to the first electrical connecting section;

a cover disposed over the base forming a first gap disposed over the first electrical connecting section and the barb section, wherein the cover is provided with a first dent, a plurality of second dents and a third dent, in which the plurality of second dents are a plurality of hollows; and an inserting member for being inserted into the first gap and fixed by the barb section, the inserting member being provided with a second electrical connecting section for electrically connecting to the first electrical connecting section.

2. The microconnector of claim 1, wherein the first electrical connecting section and the barb section are both cambered structure curving upwards.

3. The microconnector of claim 1, wherein the first electrical connecting section comprises a plurality of female connectors.

4. The microconnector of claim 1, wherein the barb section comprises at least one spring plate.

5. The microconnector of claim 1, wherein the plurality of hollows are arranged periodically.

6. The microconnector of claim 1, wherein an undercut is further formed at the cover corresponding to the edge of the first gap.

7. The microconnector of claim 1, wherein the second electrical connecting section comprises a plurality of male connectors.

8. The microconnector of claim 1, wherein the cover combined with the base to form a female connector, and the inserting member is a male connector.

9. The microconnector of claim 1, wherein the cover is combined with the base via gel or the semiconductor fabricating process.

10. The microconnector of claim 1, wherein the barb section is spaced apart from the first electrical connecting section.

11. The microconnector of claim 1, wherein the plurality of second dents are formed at the bottom of the first dent.

12. The microconnector of claim 11, wherein the sunken depth of the third dent is larger than that of the first dent, so that a second gap is further formed between the cover and the first electrical connecting section and the barb section.

13. The microconnector of claim 1, wherein:

the inserting member has a dent section formed at a bottom portion thereof, wherein the second electrical connecting section of the inserting member is also formed at the bottom portion;

the barb section is provided over a top surface of the base; and the barb section is engageable with the dent section of the inserting member.

14. The microconnector of claim 13, wherein the first electrical connecting section is provided over the top surface of the base.

15. The microconnector of claim 14, wherein:

when the inserting member is being inserted into the first gap, the first electrical connecting section is bent downward; and after the inserting member is inserted, the first electrical connection section and the barb section curve upward, so that a free end of the barb section is disposed further from the top surface of the base than a fixed end of the barb section, and the first electrical connecting section is electrically connected to the second electrical connecting section of the inserting member, and the free end of the barb section engages with the dent section of the inserting member.

* * * * *